United States Patent [19]

Rose

[11] Patent Number: 4,878,308

[45] Date of Patent: Nov. 7, 1989

[54] ADJUSTABLE SHOTGUN RIB

[75] Inventor: Clyde E. Rose, South Weber, Utah

[73] Assignee: Browning Corporation, Morgan, Utah

[21] Appl. No.: 338,329

[22] Filed: Apr. 17, 1989

[51] Int. Cl.[4] ..... F41G 1/46
[52] U.S. Cl. ..... 42/102
[58] Field of Search ..... 42/102; 33/254

[56] References Cited

U.S. PATENT DOCUMENTS

| | | | |
|---|---|---|---|
| 1,323,151 | 11/1919 | Burton | 42/102 |
| 2,669,052 | 2/1954 | Simmons | 42/102 |
| 3,171,226 | 3/1965 | Into | 42/102 |
| 4,208,821 | 6/1980 | Power | 33/254 |

FOREIGN PATENT DOCUMENTS

| | | | |
|---|---|---|---|
| 376364 | 11/1939 | Italy | 42/102 |

OTHER PUBLICATIONS

Catalog, *Browning Arms Co.,* 1970, Advertisement on new Browning BT-99.

Catalog, *Browning,* 1981, Advertisement on Citori Trap & Skeet Shotgun.

*Primary Examiner*—Deborah L. Kyle
*Assistant Examiner*—Michael J. Carone
*Attorney, Agent, or Firm*—Trask, Britt & Rossa

[57] ABSTRACT

A sighting rib for a shotgun is mounted atop a barrel by means of structure carried at the muzzle and breach ends, respectively. The front mounting permits longitudinal movement but fixes the vertical position of the rib at one of a plurality of selected locations. The breach mounting provides vertical adjustment but restrains longitudinal movement of the rear end of the rib. The attitude of the sighting plane is adjustable through the mountings to fix the point of impact with respect to the point of aim at a selected distance.

16 Claims, 3 Drawing Sheets

ADJUSTABLE SHOTGUN RIB

BACKGROUND OF THE INVENTION

1. Field

This invention relates to shotguns and is particularly directed to sighting ribs used with such guns.

2. State of the Art

Ventilated ribs have long been used with shotguns and particularly with those used for competitive target shooting. These rib structures have several functions and features which are regarding as desirable by shooters, especially in circumstances requiring repetitive shooting, (which tends to heat the barrel), and competitive or field circumstances which require quick target alignment. These ribs conventionally carry a sighting plane which is approximately flat and planar. The sighting plane may have longitudinal grooves or other features to assist in sighting, culminating in a conventional bead sight at the muzzle end of the gun.

A typical vented rib gun includes a barrel with a longitudinal axis oriented approximately normal the shoulder of a shooter in firing position. The barrel has a muzzle end and a breach end intersected by the longitudinal axis. A rib element which is approximately the same length as the barrel element, but will ordinarily be several inches shorter than the barrel, is mounted atop the barrel with a front end approximately coterminus with the muzzle end and a rear end near but usually somewhat forward of the breach end of the barrel.

Because the rib element is mounted atop the barrel, recoil is directed lower on the shooter's shoulder, away from the shooter's face. Moreover, because of the rib's ventilated structure and its location, the sighting plane carried by the upper surface of the rib element is much less affected by heat than is the barrel; that is, the ventilated rib element overcomes many of the effects of distortion characteristic of shotguns which do not have this feature.

It is desirable for the point of impact of target shotguns at a prescribed sighting range, typically 40 yards, to be several inches higher than the point of aim determined by the plane of the shotgun rib on the relationship of the front and center bead. Accordingly, while the ventilated rib is mounted atop and approximately parallel the longitudinal axis of the barrel, it is typically structured to hold the sighting plane at an attitude sufficiently out of alignment with the longitudinal axis of the barrel to achieve this elevated point of impact. Adjustment of the point of impact at a standard distance is desirable and is provided for in most guns by means for adjusting the elevation of either a rear sight or the front bead sight. Heretofore, however, it has not been practical to adjust the attitude of the sighting plane of a rib element with respect to the longitudinal axis of a barrel. While it has been suggested that the front end of the rib element be mounted in a fashion permitting changes in elevation of the front rib end, efforts to produce a practical gun with that feature have apparently not been successful. It is considered highly desirable for a shotgun to have the capability of adjusting the point of impact with respect to the point of sight at a standard distance. There remains a need in the art to incorporate this feature in high quality shotguns which have ventilated rib elements mounted atop the barrel.

SUMMARY OF THE INVENTION

The present invention provides an adjustable rib system for a shotgun which provides for adjustment at the rear rib end as well as the front rib end. According to certain preferred embodiments, an adjustable stock is utilized in conjunction with the adjustable rib of this invention. The comb of the stock is adjustable in height so that a "FIG. 8" sight picture of center and front beads can be attained without regard to the rib position.

The system of this invention includes a shotgun barrel with a longitudinal axis, a muzzle end and a breach end. The barrel carries a mounting post near the muzzle end and a retaining streucture near its breach end. The post and retaining structure anchor a rib element which will be nearly as long but typically somewhat shorter than the barrel.

The rib element is of conventional structure in that it has an upper, approximately planar, sighting surface and a lower surface oriented approximately parallel but spaced from the barrel. This spacing isolates the rib from heat conduction from the barrel, thereby avoiding distortion of the sighting plane. The rib element has a front rib end in the proximity of the mounting post and a rear rib end in the proximity of the retaining structure. The post and front rib end are mutually adapted by associated connecting structure for a pivotal connection. The connection means associated with the mounting post and the front rib end is constructed and arranged so that the front rib can be attached to the post at selected elevations with respect to the barrel. Ideally, the pivot connection retains the front rib end from transverse motion with respect to the barrel while permitting limited axial movement with respect to the barrel. The connection means associated with the retaining structure and the rear rib end is constructed and arranged to provide for a coupling of the rear rib end with the retaining structure. This rear coupling should prevent longitudinal axial movement of the rib with respect to the longitudinal axis of the barrel while providing for transverse elevational movement of the rear rib end with respect to the barrel, thereby permitting adjustment of the spacing of the rear rib end with respect to the barrel.

The mounting post is ordinarily a structural member upstanding from the barrel. It is preferably formed as a generally rectilinear element with a major axis parallel the axis of the barrel. The post thus has spaced, approximately parallel sidewalls oriented approximately normal the barrel. A pair of slots may be provided through the post with entries through the respective parallel sidewalls being approximately parallel the barrel. Accordingly, a pin entered through the slots may travel longitudinally axially with respect to the barrel but is restrained from vertical transverse motion. The front rib includes a pair of longitudinal members, one of which carries the upper sighting surface and the other of which carries the lower rib surface. These upper and lower rib members are connected by structure, a forward portion of which may be provided with a channel configured to receive the mounting post between approximately parallel first and second sidewalls. The first and second sidewalls may carry corresponding bores which may be brought into registration with a selected slot in the post so that a pin may be positioned through a bore in a first sidewall, through the slot, and then through a corresponding bore in a second sidewall. In this fashion, a pivot connection is provided between the mounting post and the front rib end which permits longitudinal movement of the pin in the slot (and thus the front rib end with respect to the barrel) but limits transverse movement of the front rib with respect to the barrel.

The retaining structure mounted near the breach end of the barrel may be formed as a rear rib housing. The housing includes support means for receiving the rear rib end between approximately parallel retaining surfaces. These retaining surfaces will ordinarily comprise the inner surfaces of upstanding sidewalls defining an internal chamber. The chamber is also configured to accommodate a spring oriented to bear against the lower surface of the rib element, thereby to bias the rear rib end away from the barrel. In most instances the spring is a strong leaf spring disposed approximately parallel the barrel within the rear rib housing. The spring urges the rib element upward away from the barrel against an adjustment mechanism mounted in opposition to the biasing spring. The adjustment mechanism, which may be formed as a structural element mounted within the chamber for movement against the biasing spring, limits the spacing between the barrel and the rear rib end.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 1:
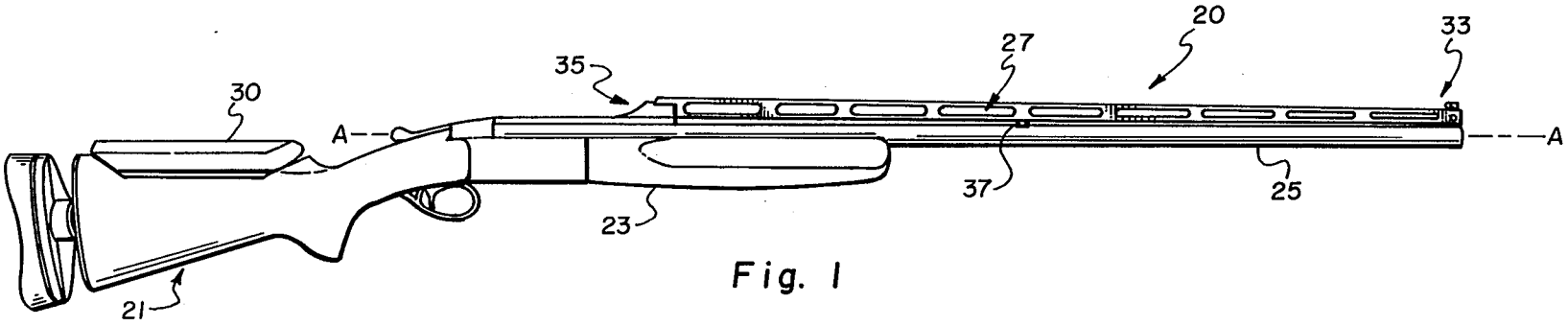
FIG. 1 is a view in perspective illustrating a typical shotgun embodying the invention.

A single barrel trap shotgun, designated generally 20, includes a stock, designated generally 21, a forearm 23, a barrel 25 supported by the stock 21 and forearm 23, and a ventilated rib element 27. The stock assembly 21 is fully adjustable for drop, recoil pad angular position, cast and length of pull. It includes an adjustable comb 30 which may be positioned selectively with respect to the longitudinal axis A of the barrel 25, as well as for cast on and off.

Figure 2:
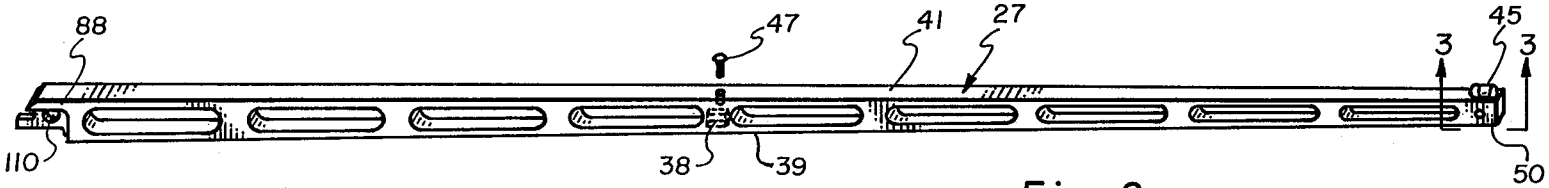
FIG. 2 is a view in perspective of a rib element of the invention.
Figure 3:
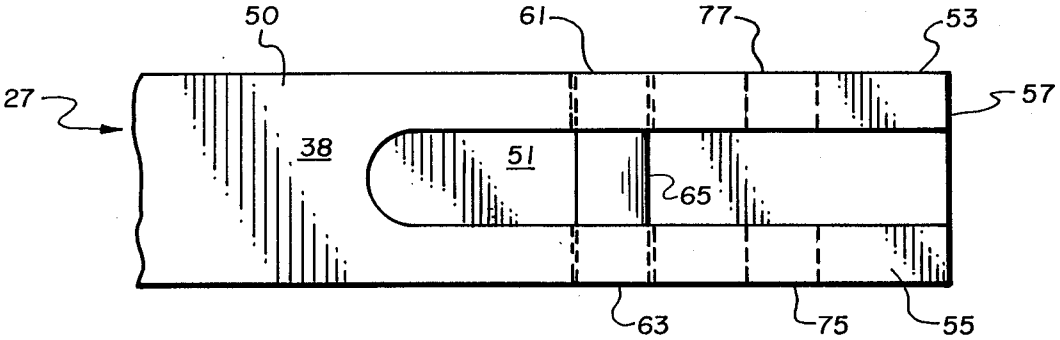
FIG. 3 is a fragmentary view taken along the lines 3—3 of FIG. 2.

As best illustrated by FIG. 2, the rib element 27 is a separate structure. It is mounted atop the barrel by means of front and rear mounting assemblies designated generally 33 and 35, respectively, on FIG. 1. A center mounting post 37 may also engage an appropriate recess 38 in the lower surface 39 of the rib element 27. The upper surface 41 of the rib element 27 constitutes a sighting plane for the firearm 20 and is approximately flat and planar with the exception of a front sight 45 and center sight 47 upstanding from the surface 41. The front rib end 50 is milled or otherwise machined, as best shown by FIG. 3, to provide a channel 51 between opposed, approximately parallel, elements 53, 55, which may be regarded as first and second sidewalls. The channel is in open communication with the bottom surface 39 of the rib element 27 and the terminal front end 57 of the rib element 27, but does not extend to the upper surface 41 of the rib element 27, terminating beneath the front sight 45. Matching opposed bores 61, 63 in the sidewalls 53, 55, respectively, accommodate a roll pin 65.

Figure 4:
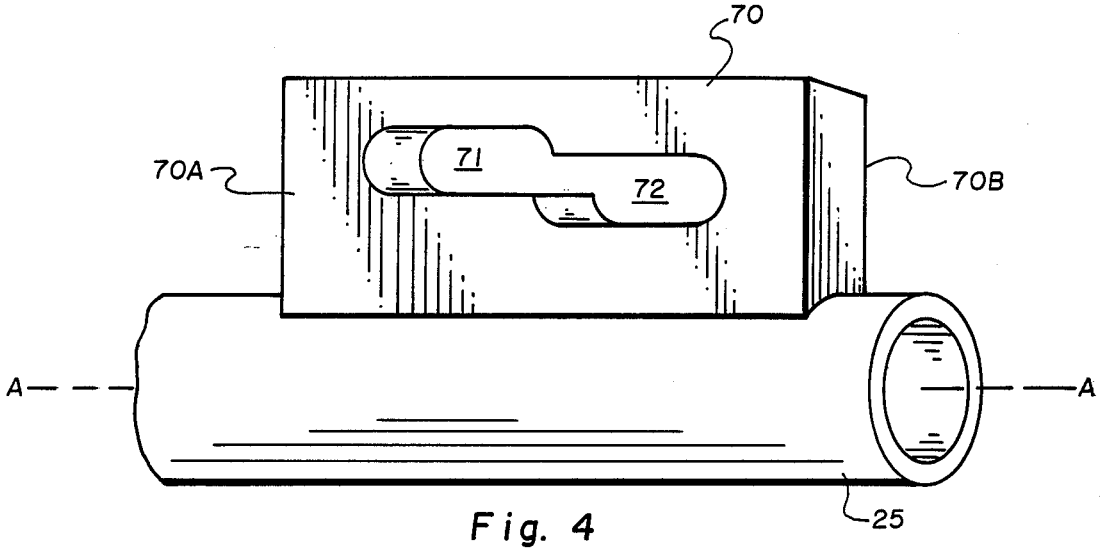
FIG. 4 is a view in elevation of a front mounting post of the invention.
Figure 5:
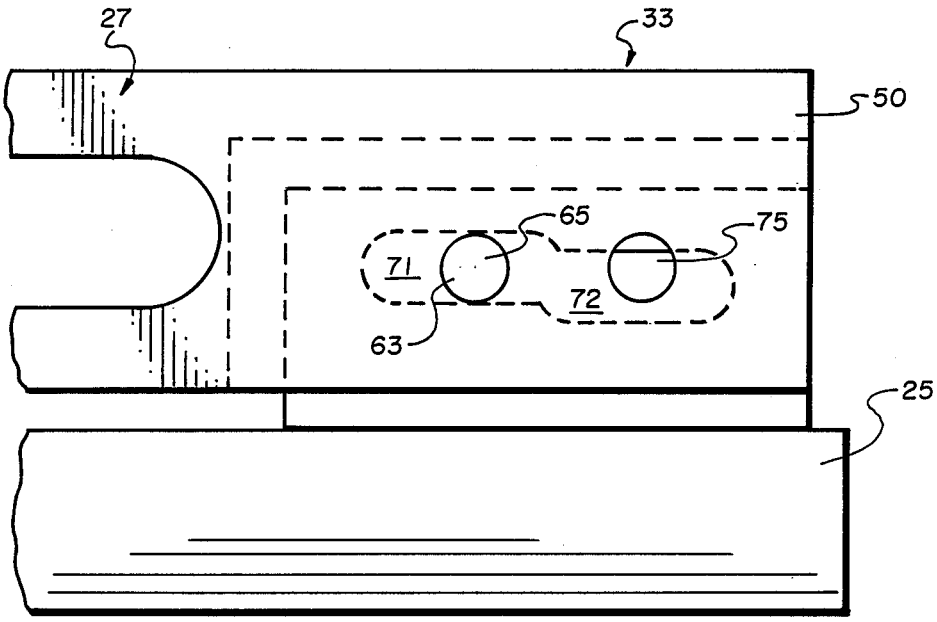
FIG. 5 is a view illustrating the components illustrated by FIGS. 3 and 4 in assembled condition.

FIG. 4 illustrates a mounting post 70 welded or otherwise fixed atop and upstanding from the barrel 25. A first slot 71 and a second slot 72 pass directly through the post 70 so that they each have openings or entryways through the respective sidewalls 70A, 70B (not visible). As illustrated, each of the slots 71, 72 has a major longitudinal dimension approximately parallel the axis A of the barrel and a transverse dimension also approximately parallel the barrel 25. As best shown by FIG. 5, the channel 51 of the end 50 of rib 27 is placed over the mounting post 70 and a roll pin 65 is placed through the bore 63, the slot 71 and out the opposite bore 61 (see FIG. 3). An alternate bore 75 and a corresponding opposite bore (not visible) through the sidewalls 53, 55 may register with the slot 72. The elongated slot 71 compensates for longitudinal rib movement with respect to the barrel caused by heat and barrel whip as a consequence of discharging the shotgun 20.

Figure 6:
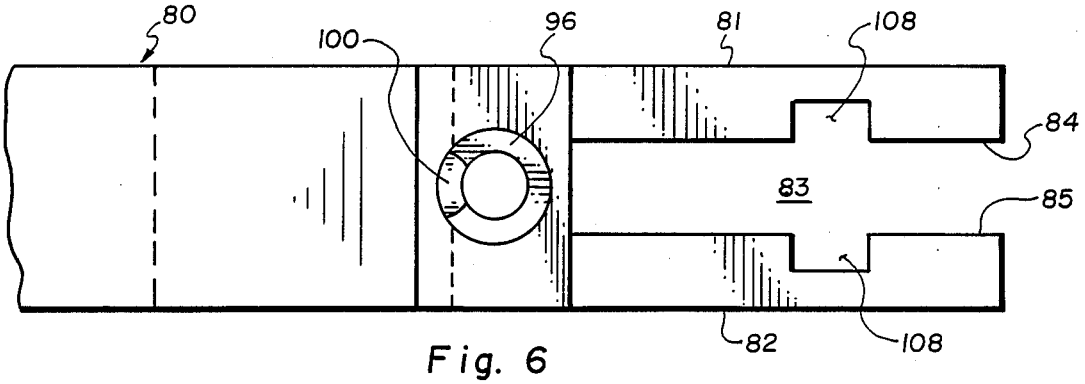
FIG. 6 is a top plan view of a rear rib housing of the invention.
Figure 7:
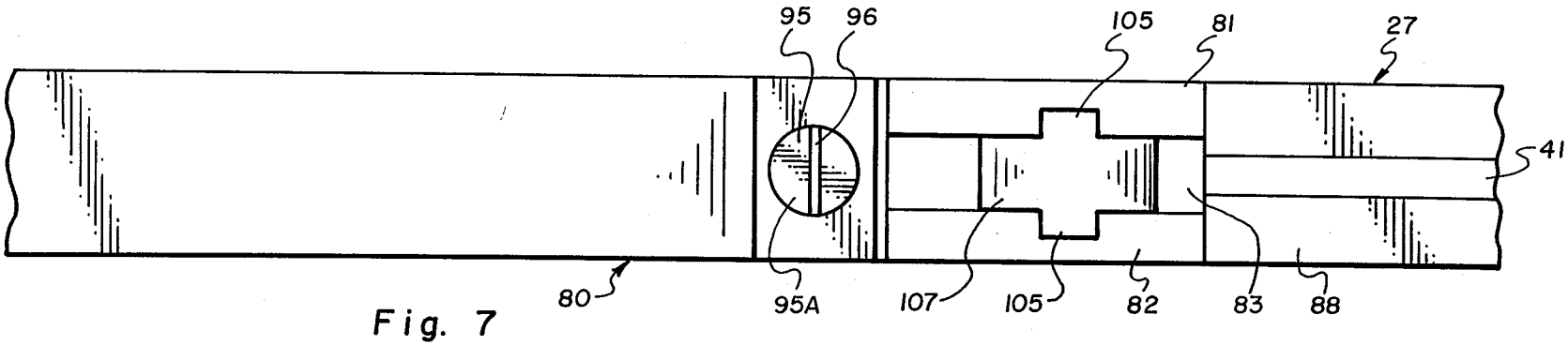
FIG. 7 is a top plan view of the rear rib end installed in the rear bib housing of FIG. 6.
Figure 8:
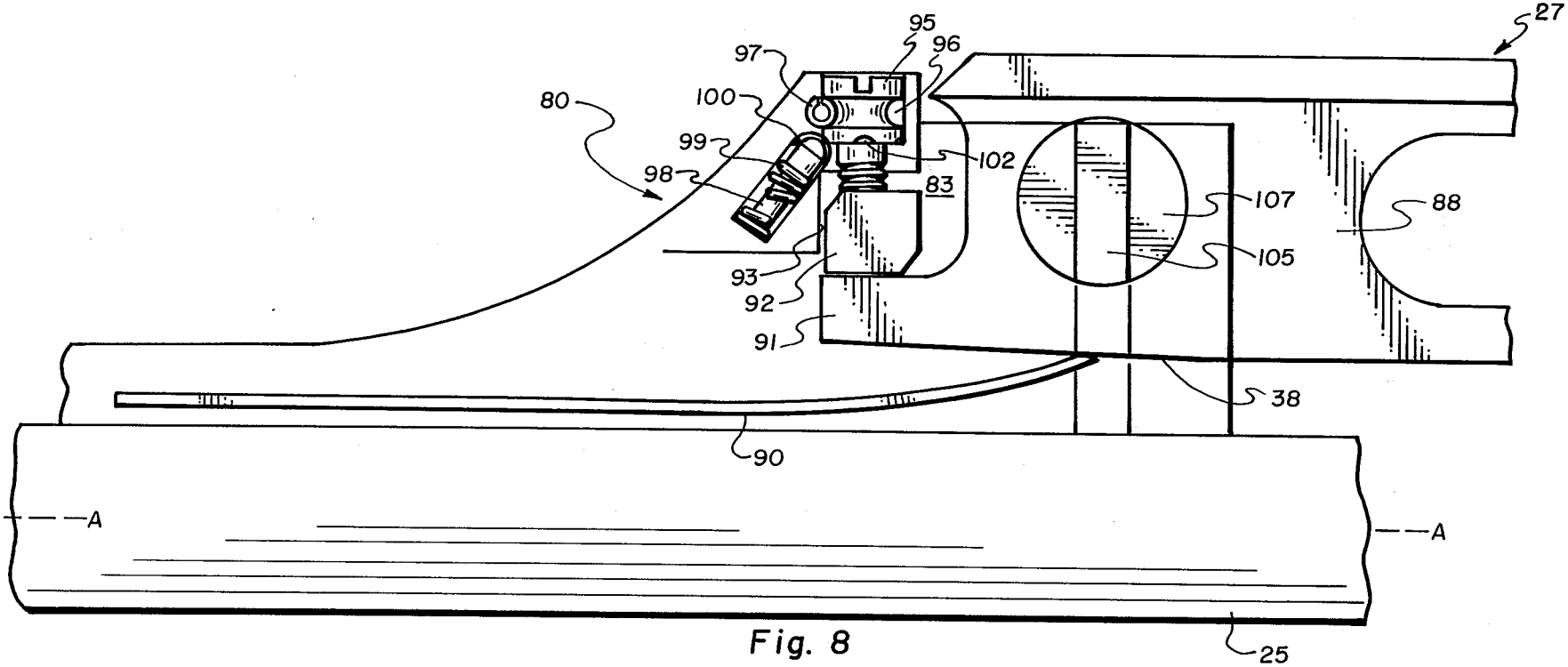
FIG. 8 is a view similar to FIG. 7 rotated 90° to an elevation view.

FIGS. 6, 7 and 8 illustrate a rear rib end housing designated generally 80. Referring to FIG. 8, the housing 80 is welded or otherwise fixed directly atop and upstanding from the barrel 25 of the shotgun 20 (FIG. 1). The housing 80 includes upstanding approximately parallel sidewalls 81, 82 defining an internal chamber 83. The walls 81, 82 comprise approximately parallel retaining surfaces 84, 85 (FIG. 6) which receive the rear rib end 88. A leaf spring 90 mounted within the chamber 83 is depressed by the bottom surface 39 of the rib 27. The rib 27 is thereby biased away from the barrel 25. An extension 91 bears against an adjustment nut 92 which is retained against rotation by the surface 93. Nut 92 is threadedly engaged by an adjustment screw 95 rotatably mounted within a well 96 (FIG. 6) so that its slotted head 95A is accessible from outside the housing 80. The screw 95 is restrained against axial movement by the adjustment screw retaining pin 97. A locking plunger 98 is biased by a spring 99 mounted within a bore 100 as best shown by FIG. 8. The plunger 98 engages detents 102 provided at intervals along the perimeter of the screw head 95A. Turning of the screw 95 either clockwise or counterclockwise effects a corresponding vertical movement up or down, respectively, of the adjustment nut 92, thereby either permitting the rib 27 to lift or forcing it to lower with respect to the barrel 25. Longitudinal axial movement of the end 88 of the rib 27 with respect to the axis A is prevented by rectilinear shoulders 105 of a rib pivot 107. The shoulders 105 slide in channels 108 (FIG. 6) in the walls 81, 82. Apart from the shoulders 105, the rib pivot 107 is configured as a round slug rotatably positioned within the bore 110 in the rear rib end 88. With the slug pivot mounted as illustrated by FIGS. 7 and 8, the rear rib end 88 is permitted vertical motion approximately transverse the axis A of the barrel 25, turning as required on the pivot 107 while the shoulders 105 move vertically in the channels 108, without permitting any axial longitudinal movement of the end 88 of the rib 27. Any such movement of the rib 27 is accommodated at the front mounting 33.

The aforedescribed arrangement of mounting mechanisms at the front and rear of the vented rib 27 permit extraordinary adjustment capabilities of the point of impact with respect to the point of sight. In a typical arrangement of the type shown, for example, with the pin 65 positioned through the borehole 75 in the lower slot 72 (FIG. 5), turning of the screw 95 can adjust the point of impact above the point of aim at 40 yards within the range of six to twelve inches. With the pin 65 located in the upper slot 71, rotation of the screw 95 can adjust the point of impact at the same distance within the range of from three to nine inches above the point of aim. These adjustments are by way of example only, being based upon an inherent minimum built-in impact point of three inches above the point of aim at 40 yards. It should be recognized that the adjustment structures of this invention may be applied to guns with either greater or lesser built-in biases and that the structures can be modified to provide for either greater or lesser adjustment ranges. The foregoing example is considered practical and well within the range generally preferred by present-day gunners.

Figure 9:
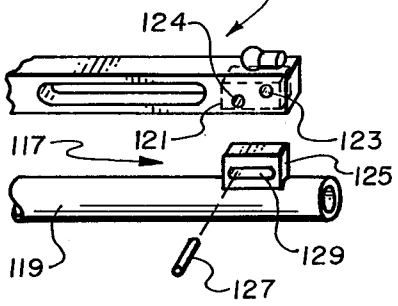
FIG. 9 is an exploded view of an alternative front mounting assembly.

Referring to FIG. 9, an alternative front mounting is effected between a rib, designated generally 155 and mounting post element, designated generally 117, upstanding from a barrel 119. A cavity 121 communicates with bores 123, 124 at different elevations with respect to the barrel 119. The fixture 125 is received by the cavity 121. A pin 127 is selectively inserted through either of the bores 123, 124 and slot 129, thereby establishing the elevation of the sight 45 with respect to the axis A (FIGS. 1 and 2).

Reference herein to specific details of the illustrated embodiments is not intended to restrict the scope of the appended claims which themselves recite those features regarded as important to the invention.

What is claimed:

1. An adjustable sight rib system for a shotgun, said system comprising:

a shotgun barrel with a longitudinal axis, a muzzle end a breach end, said barrel carrying a mounting post near said muzzle end and a retaining structure near said breach end;

a rib element of approximately the same length as the barrel, said rib having an upper, approximately planar sighting surface and a lower surface oriented approximately parallel but spaced from said barrel so that said rib element has a front rib end in the proximity of said mounting post and a rear rib end in the proximity of said retaining structure;

front connection means associated with said mounting post and said front rib end, constructed and arranged such that said front rib end can be attached to said post at selected elevations with respect to said barrel by a pivot connection; and rear connection means associated with said retaining structure and said rear rib end can be coupled with said retaining structure to prevent longitudinal movement of said rib with respect to said longitudinal axis while permitting adjustment of the spacing of said rear rib end with respect to said barrel.

2. A system according to claim 1 wherein said mounting post is a structural member upstanding from said barrel and is provided with slots above and approximately transverse said barrel, said slots having opposed entries approximately parallel said barrel; and said front rib end includes a channel configured to receive said mounting post between approximately parallel first and second sidewalls, said first and second sidewalls carrying corresponding bores which may be brought into registration with a said slot so that a pin may be positioned through a bore in said first sidewall, through a said slot and through a said corresponding bore in said second sidewall, thereby forming a pivot connection between said mounting post and said front rib end which permits longitudinal movement of said front rib end with respect to said barrel but limits transverse movement of said front rib end with respect to said barrel.

3. A system according to claim 1 wherein said mounting post is a structural member upstanding from said barrel and is provided with a slot above and approximately transverse said barrel, said slot having opposed entries approximately parallel said barrel; and said front rib end includes a channel configured to receive said mounting post between approximately parallel first and second sidewalls, said first and second sidewalls each carrying a plurality of corresponding bores which may be brought into registration with said slot so that a pin may be positioned through a selected said bore in said first sidewall, through said slot and through a said corresponding bore in said second sidewall, thereby forming a pivot connection between said mounting post and said front rib end which permits longitudinal movement of said front rib end with respect to said barrel but limits transverse movement of said front rib end with respect to said barrel.

4. A system according to claim 1 wherein said retaining structure includes support means for receiving said rear rib end between approximately parallel retaining surfaces; biasing means mounted in association with said rear rib end for biasing said rear rib end away from said barrel, and adjustment means mounted in opposition to said biasing means, whereby to fix within limits the spacing between said barrel and said rear rib end.

5. A system according to claim 4 wherein said retaining structure is configured as a rear rib housing mounted atop the breach end of said barrel, said housing including approximately parallel upstanding sidewalls defining an internal chamber which includes said approximately parallel retaining surfaces and accommodates, as said biasing means, a spring oriented to bear against said lower surfaces of said rib element.

6. A system according to claim 5 wherein said spring is a leaf spring mounted approximately parallel said longitudinal axis of said barrel and said adjustment means comprises an adjustment nut mounted within said chamber atop a rearward projection of said rib element and an adjustment screw with an axis transverse said longitudinal axis of said barrel, said screw including a head rotatably mounted in said housing to be accessible from outside said housing, and a shaft threadedly engaged with said nut, said nut being restrained from rotational movement and said head being restrained from axial movement, whereby rotation of said head effects movement of said projection selectively towards or away from said barrel.

7. A system according to claim 6 wherein said mounting post is a structural member upstanding from said barrel and is provided with slots above and approximately transverse said barrel, said slots having opposed entries approximately parallel said barrel; and said front rib end includes a channel configured to receive said mounting post between approximately parallel first and second sidewalls, said first and second sidewalls carrying corresponding bores which may be brought into registration with a said slot so that a pin may be positioned through a bore in said first sidewall, through a said slot and through a said corresponding bore in said second sidewall, thereby forming a pivot connection between said mounting post and said front rib end which permits longitudinal movement of said front rib end with respect to said barrel but limits transverse movement of said front rib end with respect to said barrel.

8. A system according to claim 6 wherein said mounting post is a structural member upstanding from said barrel and is provided with a slot above and approximately transverse said barrel, said slot having opposed entries approximately parallel said barrel; and said front rib end includes a channel configured to receive said mounting post between approximately parallel first and second sidewalls, said first and second sidewalls each carrying a plurality of corresponding bores which may be brought into registration with said slot so that a pin may be positioned through a selected said bore in said first sidewall, through said slot and through a selected corresponding bore in said second sidewall, thereby forming a pivot connection between said mounting post and said front rib end which permits longitudinal movement of said front rib end with respect to said barrel but limits transverse movement of said front rib end with respect to said barrel.

9. A system according to claim 1 in combination with a stock supporting said barrel, said stock including a comb member which is adjustably mounted with respect to the remainder of said stock, whereby to permit location of said comb at selected elevational positions with respect to said longitudinal axis of said barrel.

10. A system according to claim 9 wherein said mounting post is a structural member upstanding from said barrel and is provided with slots above and approximately transverse said barrel, said slots having opposed entries approximately parallel said barrel; and said front rib end includes a channel configured to receive said mounting post between approximately parallel first and second sidewalls, said first and second sidewalls carrying corresponding bores which may be brought into registration with a said slot so that a pin may be positioned through a bore in said first sidewall, through a said slot and through a said corresponding bore in said second sidewall, thereby forming a pivot connection between said mounting post and said front rib end which permits longitudinal movement of said front rib end with respect to said barrel but limits transverse movement of said front rib end with respect to said barrel.

11. A system according to claim 9 wherein said mounting post is a structural member upstanding from said barrel and is provided with a slot above and approximately transverse said barrel, said slot having opposed entries approximately parallel said barrel; and said front rib end includes a channel configured to receive said mounting post between approximately parallel first and second sidewalls, said first and second sidewalls each carrying a plurality of corresponding bores which may be brought into registration with said slot so that a pin may be positioned through a selected said bore in said first sidewall, through said slot and through a selected corresponding bore in said second sidewall, thereby forming a pivot connection between said mounting post and said front rib end which permits longitudinal movement of said front rib end with respect to said barrel but limits transverse movement of said front rib end with respect to said barrel.

12. A system according to claim 9 wherein said retaining structure includes support means for receiving said rear rib end between approximately parallel retaining surfaces; biasing means mounted in association with said rear rib end for biasing said rear rib end away from said barrel, and adjustment means mounted in opposition to said biasing means, whereby to fix within limits the spacing between said barrel and said rear rib end.

13. A system according to claim 12 wherein said retaining structure is configured as a rear rib housing mounted atop the breach end of said barrel, said housing including approximately parallel upstanding sidewalls defining an internal chamber which includes said approximately parallel retaining surfaces and accommodates, as said biasing means, a spring oriented to bear against said lower surfaces of said rib element.

14. A system according to claim 13 wherein said spring is a leaf spring mounted approximately parallel said longitudinal axis of said barrel and said adjustment means comprises an adjustment nut mounted within said chamber atop a rearward projection of said rib element and an adjustment screw with an axis transverse said longitudinal axis of said barrel, said screw including a head rotatably mounted in said housing to be accessible from outside said housing, and a shaft threadedly engaged with said nut, said nut being restrained from rotational movement and said head being restrained from axial movement, whereby rotation of said head effects movement of said projection selectively towards or away from said barrel.

15. A system according to claim 14 wherein said mounting post is a structural member upstanding from said barrel and is provided with slots above and approximately transverse said barrel, said slots having opposed entries approximately parallel said barrel; and said front rib end includes a channel configured to receive said mounting post between approximately parallel first and second sidewalls, said first and second sidewalls carrying corresponding bores which may be brought into registration with a said slot so that a pin may be positioned through a bore in said first sidewall, through a said slot and through a said corresponding bore in said second sidewall, thereby forming a pivot connection between said mounting post and said front rib end which permits longitudinal movement of said front rib end with respect to said barrel but limits transverse movement of said front rib end with respect to said barrel.

16. A system according to claim 14 wherein said mounting post is a structural member upstanding from said barrel and is provided with a slot above and approximately transverse said barrel, said slot having opposed entries approximately parallel said barrel; and said front rib end includes a channel configured to receive said mounting post between approximately parallel first and second sidewalls, said first and second sidewalls each carrying a plurality of corresponding bores which may be brought into registration with said slot so that a pin may be positioned through a selected said bore in said first sidewall, through said slot and through a selected corresponding bore in said second sidewall, thereby forming a pivot connection between said mounting post and said front rib end which permits longitudinal movement of said front rib end with respect to said barrel but limits transverse movement of said front rib end with respect to said barrel.

* * * * *

UNITED STATES PATENT AND TRADEMARK OFFICE

CERTIFICATE OF CORRECTION

PATENT NO. : 4,878,308

DATED : Nov. 7, 1989

INVENTOR(S) : Clyde E. Rose

It is certified that error appears in the above-identified patent and that said Letters Patent is hereby corrected as shown below:

In column 5, line 60, claim 1, after "end", insert --, constructed and arranged such that said read rib end--.

Signed and Sealed this

Second Day of October, 1990

*Attest:*

HARRY F. MANBECK, JR.

*Attesting Officer*

*Commissioner of Patents and Trademarks*